US010755640B2

(12) United States Patent
Jin et al.

(10) Patent No.: US 10,755,640 B2
(45) Date of Patent: Aug. 25, 2020

(54) THRESHOLD VOLTAGE HYSTERESIS COMPENSATION

(71) Applicant: Apple Inc., Cupertino, CA (US)

(72) Inventors: Jiayi Jin, Saratoga, CA (US); Paolo Sacchetto, Cupertino, CA (US); Maofeng Yang, San Jose, CA (US); Weijun Yao, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 94 days.

(21) Appl. No.: 15/701,030

(22) Filed: Sep. 11, 2017

(65) Prior Publication Data

US 2018/0090074 A1 Mar. 29, 2018

Related U.S. Application Data

(60) Provisional application No. 62/398,893, filed on Sep. 23, 2016.

(51) Int. Cl.

| | |
|---|---|
| ***G09G 3/3258*** | (2016.01) |
| ***G09G 3/20*** | (2006.01) |
| ***G09G 3/3233*** | (2016.01) |

(52) U.S. Cl.

CPC ..... *G09G 3/3258* (2013.01); *G09G 3/2007* (2013.01); *G09G 3/3233* (2013.01);

(Continued)

(58) Field of Classification Search

CPC ..... G09G 3/3258; G09G 3/2007; G09G 2300/0819; G09G 2310/08;

(Continued)

(56) References Cited

U.S. PATENT DOCUMENTS 9,397,649 B2 * 7/2016 Shimada ..... H01L 29/78648
2011/0080437 A1 * 4/2011 Yamashita ..... G09G 3/3233 345/690

(Continued)

FOREIGN PATENT DOCUMENTS

EP 2876633 A1 * 5/2015

OTHER PUBLICATIONS

Lin et al, "LTPS-TFT Pixel Circuit to Compensate for OLED Luminance Degradation in Three-Dimensional AMOLED Display", IEEE Electron Device Letters, v. 33, No. 5, p. 700-702 (May 2012). (Year: 2012).*

(Continued)

*Primary Examiner* — Julie Anne Watko
(74) *Attorney, Agent, or Firm* — Fletcher Yoder P.C.

(57) ABSTRACT

Electronic devices, storage medium containing instructions, and methods pertain to determining a target boosted threshold voltage level based at least in part on a target emission threshold voltage level. Using the determined target boosted threshold voltage level, a light emitting diode (LED)-controlling transistor is submitted to voltage stress to boost a threshold voltage of the transistor to the target boosted threshold voltage level during a first portion of a refresh period between first and second emission periods. During a second portion of the refresh period, the voltage stress is de-asserted to settle the threshold voltage to a target emission threshold voltage level for the second emission period. After the voltage is settled, the LED-controlling transistor is driven based at least in part on the target emission threshold voltage level.

20 Claims, 11 Drawing Sheets

(52) U.S. Cl.
CPC ..... *G09G 2300/0819* (2013.01); *G09G 2300/0861* (2013.01); *G09G 2310/0251* (2013.01); *G09G 2310/0262* (2013.01); *G09G 2310/08* (2013.01); *G09G 2320/0247* (2013.01); *G09G 2320/043* (2013.01); *G09G 2330/02* (2013.01)

(58) Field of Classification Search
CPC ... G09G 2320/0247; G09G 2320/0261; G09G 2330/02; G09G 3/3216; G09G 3/3208; G09G 3/3266; G09G 3/3275; G09G 3/32; G09G 3/30; G09G 3/2092; G09G 3/20; G09G 3/00; G09G 3/3225; G09G 2300/0809; G09G 2300/08; G09G 2300/0804; G09G 2300/0439; G09G 2300/0421; G09G 2300/04; G09G 2230/00; G09G 2290/00; G09G 3/3233; G09G 2310/061; G09G 2310/062; G09G 2310/063; G09G 2310/0264; G09G 2310/0202; G09G 2310/20; G09G 2310/00; G09G 2320/0233; G09G 2320/02; G09G 2320/00; G09G 2310/06; G09G 2320/0257; G09G 2310/0243; G09G 2320/045; G09G 2320/046; G09G 2320/029; G09G 2320/0295; G09G 2320/04; G09G 2320/048; G09G 3/0233; G09G 2310/0262; G09G 2320/043; G09G 2300/0861; G09G 2310/0251
See application file for complete search history.

(56) References Cited

U.S. PATENT DOCUMENTS

2011/0191042 A1* 8/2011 Chaji ..... G09G 3/32 702/64
2012/0075260 A1* 3/2012 Saito ..... G09G 3/3225 345/204
2012/0112652 A1* 5/2012 Wang ..... G09G 3/3233 315/224
2014/0139505 A1* 5/2014 Han ..... G09G 3/003 345/212
2015/0145845 A1* 5/2015 Nam ..... G09G 3/3233 345/209
2016/0063955 A1* 3/2016 Yamamoto ..... H03K 3/356026 345/205

OTHER PUBLICATIONS

Huo et al, "A Pixel Circuit With Wide Data Voltage Range for OLEDoS Microdisplays With High Uniformity", IEEE Transactions on Electron Devices. (Year: 2019).*
Park et al, "Gate-induced drain leakage current characteristics of p-type polycrystalline silicon thin film transistors aged by off-state stress", Solid State Electronics 148 (2018) 20-26. (Year: 2018).*

* cited by examiner

THRESHOLD VOLTAGE HYSTERESIS COMPENSATION

CROSS REFERENCE TO RELATED APPLICATIONS

This application claims the benefit of U.S. Provisional Application No. 62/398,893, filed on Sep. 23, 2016, the contents of which are herein expressly incorporated by reference for all purposes.

BACKGROUND

The present disclosure relates generally to techniques for low visibility sensing of characteristics of a display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic display panels are used in a plethora of electronic devices. These display panels typically consist of multiple pixels that emit light. These pixels may be formed using self-emissive units (e.g., light emitting diode) or pixels that utilize units that are backlit (e.g., liquid crystal diode). These pixels are usually controlled using transistors (e.g., thin film transistors) that utilize a driving threshold voltage to determine at which level the pixels are to be driven. However, threshold voltage transients may exist at the transistors due to hysteresis. Such fluctuations of the threshold voltage may cause flicker and/or image blur. During emission, especially at low refresh rates, some charge may be trapped for the driving transistor increasing the threshold voltage. Between frames, luminance drops occur due to the threshold voltage transients thereby leading to a visible flicker in the screen.

Furthermore, due to hysteresis, transistor threshold voltage is lower at low gray scale frames and higher at high gray scale level frames. Thus, during a transition from a low gray scale level frame to a high gray scale level frame, the first high gray scale level frame appears dimmer than later frames with the same gray scale levels due to a threshold voltage sampling error during the refresh period between the low and high gray scale level frames causing a flash going from dark to bright frames or blur of dark text on a light background during page scrolling.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

By asserting voltage stress on transistors (e.g., thin film transistors) during a first part of a refresh period the threshold voltage of the transistors is boosted. These boosted threshold voltage levels are set to a level to enable settling of the threshold voltage to an appropriate level for emission based on a gray scale level for the emission during a second part of the refresh period. The boosted threshold voltage level may be tuned by changing an amount of voltage stress applied to the transistors. By boosting the threshold voltage level regardless of previous gray scale level and depending only on a target emission threshold voltage level to set a threshold voltage, the likelihood of hysteresis-based artifacts is reduced.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As previously discussed, boosting all threshold voltages to a target boosted threshold voltage level based on future threshold voltage levels, dependence upon previous threshold voltage levels is reduced. Boosting the threshold voltages is performed by placing stress on transistors (e.g., thin film transistors) during a first part of a refresh period. These boosted threshold voltage levels are set to a level to enable settling of the threshold voltage to an appropriate level for emission based on a gray scale level for the emission during a second part of the refresh period. The boosted threshold voltage level may be tuned by changing an amount of voltage stress applied to the transistors. In some embodiments, a duration of settling to the boosted threshold voltage level may be dynamic or static. If static, the duration is predetermined to a length that ensures that any possible boosted threshold voltage level may be sufficiently settled to from any previous possible threshold voltage. If dynamic, the duration may be specific to a difference between a previous threshold voltage and a target boosted threshold voltage.

Figure 1:
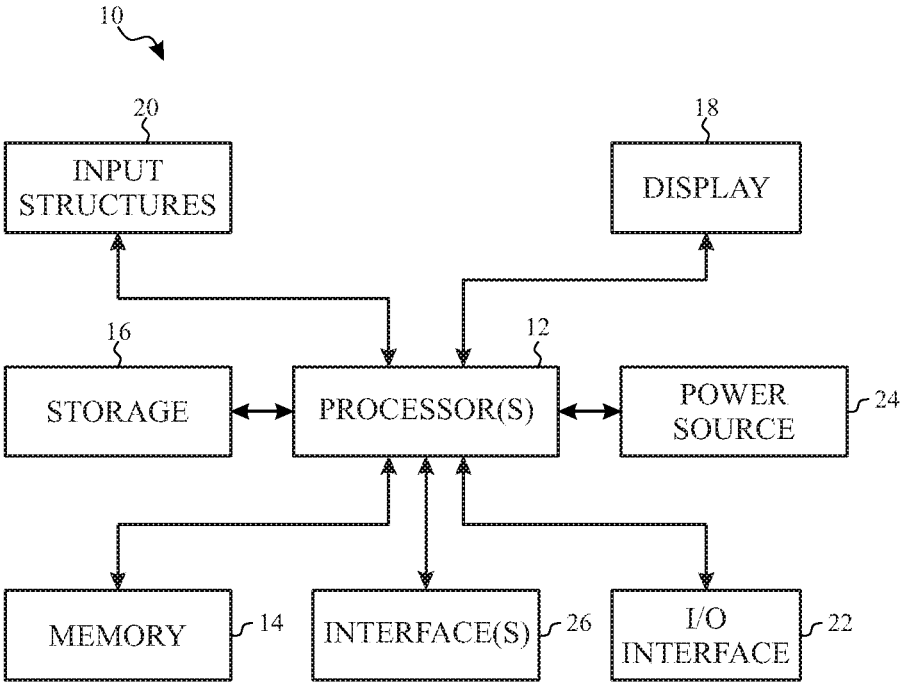
FIG. 1 is a schematic block diagram of an electronic device including a display, in accordance with an embodiment.

With the foregoing in mind and referring first to FIG. 1, an electronic device 10 according to an embodiment of the present disclosure may include, among other things, one or more processor(s) 12, memory 14, nonvolatile storage 16, a display 18, input structures 20, an input/output (I/O) interface 22, a power source 24, and interface(s) 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

In the electronic device 10 of FIG. 1, the processor(s) 12 and/or other data processing circuitry may be operably coupled with the memory 14 and the nonvolatile storage 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and/or optical discs. Also, programs (e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more light emitting diode (e.g., LED) displays, or some combination of LCD panels and LED panels.

The input structures 20 of the electronic device 10 may enable a user to interact with the electronic device 10 (e.g., pressing a button to increase or decrease a volume level, a camera to record video or capture images). The I/O interface 22 may enable the electronic device 10 to interface with various other electronic devices. Additionally or alternatively, the I/O interface 22 may include various types of ports that may be connected to cabling. These ports may include standardized and/or proprietary ports, such as USB, RS232, Apple's Lightning® connector, as well as one or more ports for a conducted RF link.

As further illustrated, the electronic device 10 may include the power source 24. The power source 24 may include any suitable source of power, such as a rechargeable lithium polymer (e.g., Li-poly) battery and/or an alternating current (e.g., AC) power converter. The power source 24 may be removable, such as a replaceable battery cell.

The interface(s) 26 enable the electronic device 10 to connect to one or more network types. The interface(s) 26 may also include, for example, interfaces for a personal area network (e.g., PAN), such as a Bluetooth network, for a local area network (e.g., LAN) or wireless local area network (e.g., WLAN), such as an 802.11 Wi-Fi network or an 802.15.4 network, and/or for a wide area network (e.g., WAN), such as a 3rd generation (e.g., 3G) cellular network, 4th generation (e.g., 4G) cellular network, or long term evolution (e.g., LTE) cellular network. The interface(s) 26 may also include interfaces for, for example, broadband fixed wireless access networks (e.g., WiMAX), mobile broadband Wireless networks (e.g., mobile WiMAX), and so forth.

Figure 2:
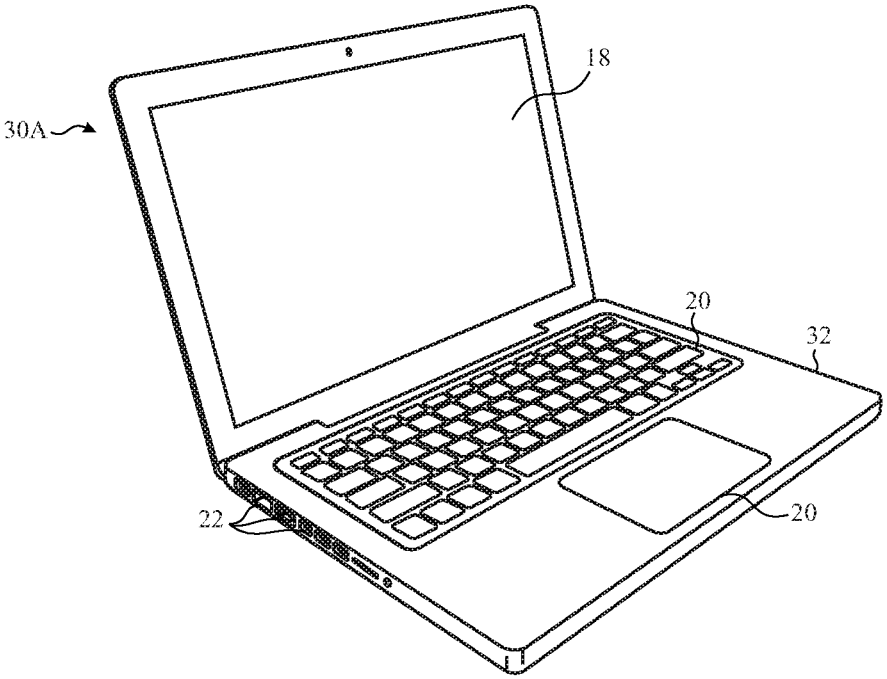
FIG. 2 is a perspective view of a notebook computer representing an embodiment of the electronic device of FIG. 1, in accordance with an embodiment.
Figure 3:
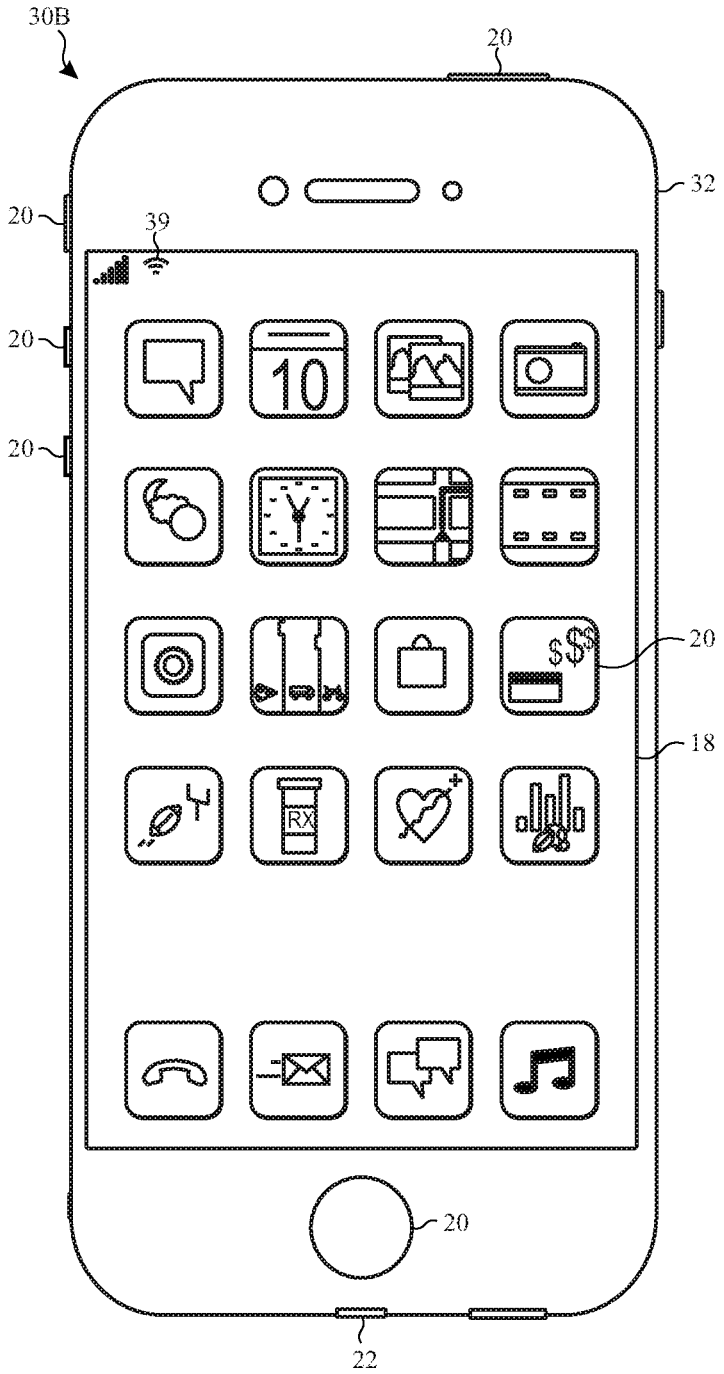
FIG. 3 is a front view of a hand-held device representing another embodiment of the electronic device of FIG. 1, in accordance with an embodiment.
Figure 4:
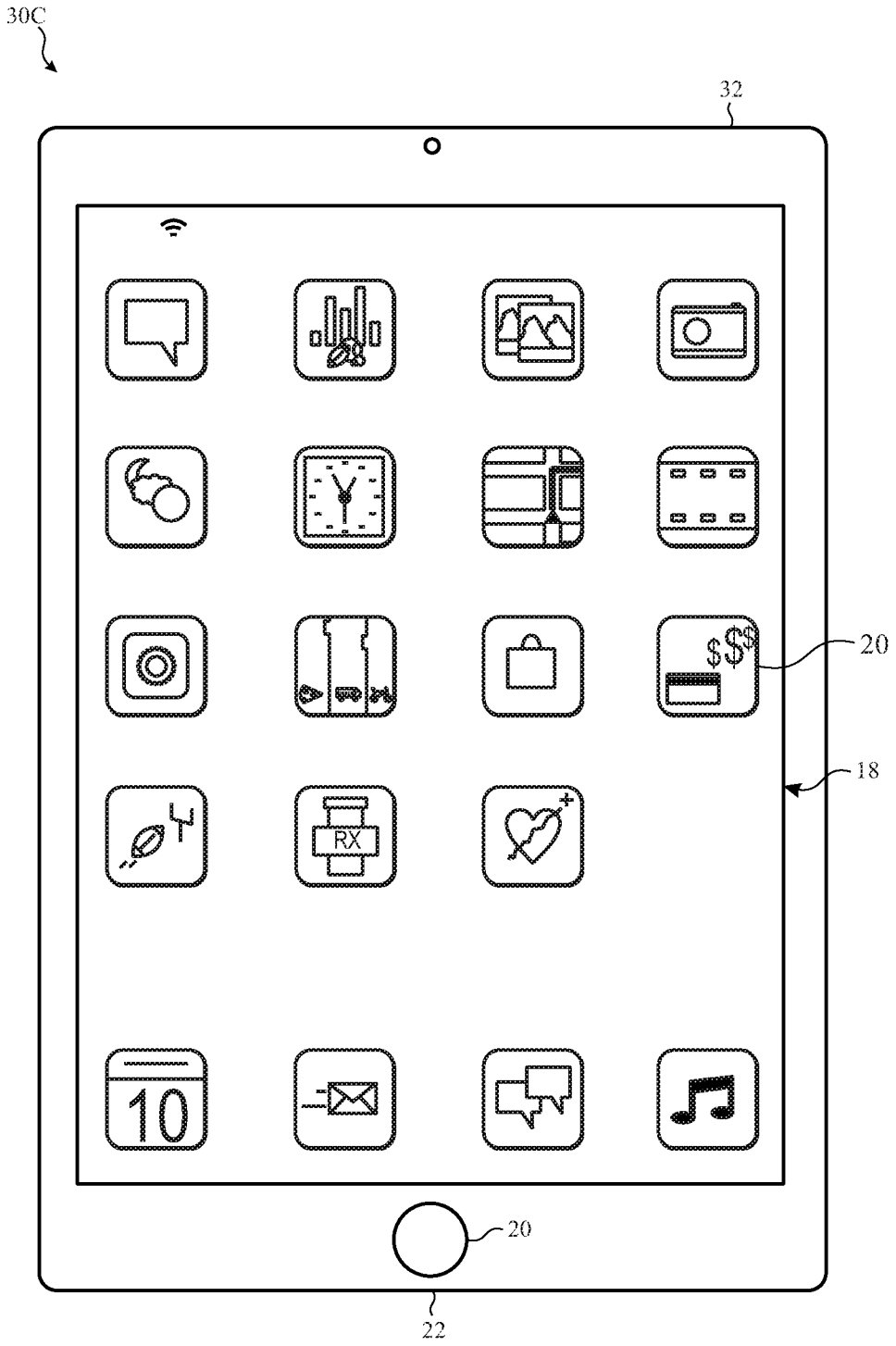
FIG. 4 is a front view of another hand-held device representing another embodiment of the electronic device of FIG. 1, in accordance with an embodiment.
Figure 5:
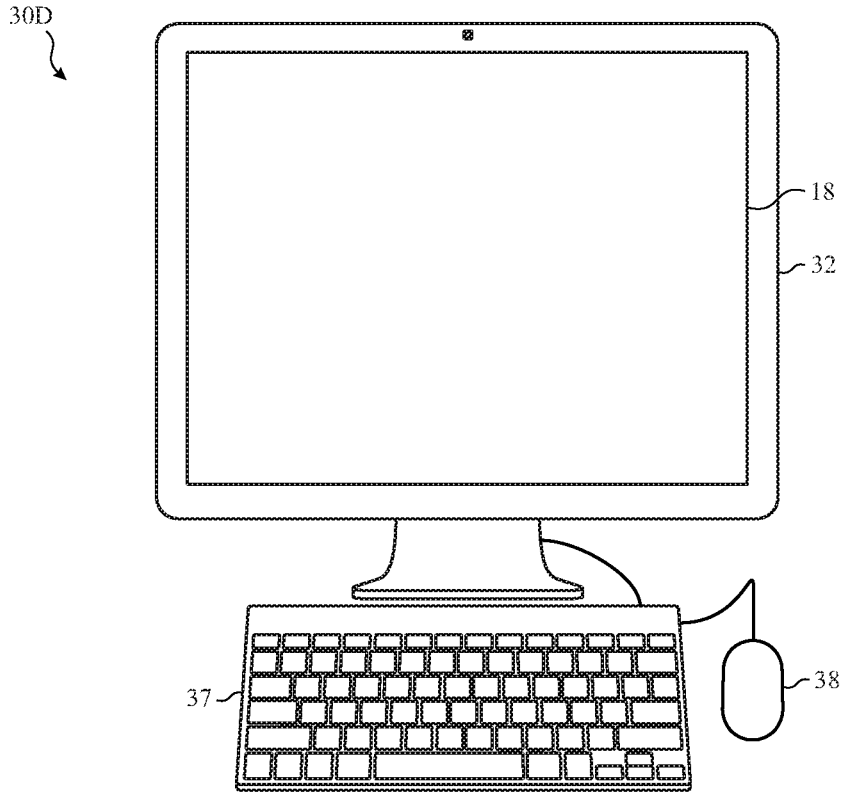
FIG. 5 is a front view of a desktop computer representing another embodiment of the electronic device of FIG. 1, in accordance with an embodiment.
Figure 6:
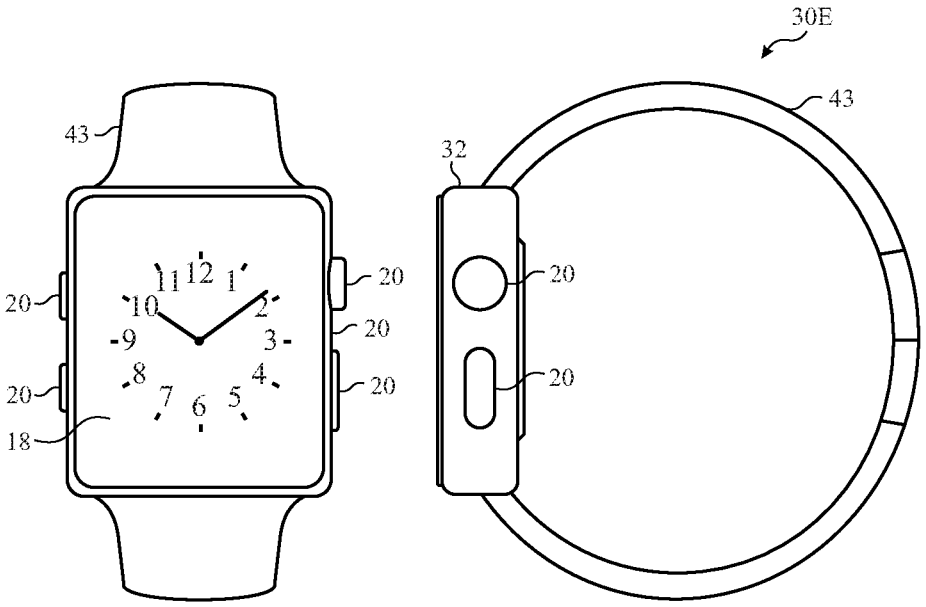
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 20, and ports of the I/O interface 22. In one embodiment, the input structures 20 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif.

The handheld device 30B may include an enclosure 32 to protect interior components from physical damage and to shield them from electromagnetic interference. The enclosure 32 may surround the display 18, which may display indicator icons. The indicator icons may indicate, among other things, a cellular signal strength, Bluetooth connection, and/or battery life. The I/O interfaces 22 may open through the enclosure 32 and may include, for example, an I/O port for a hard wired connection for charging and/or content manipulation using a connector and protocol, such as the Lightning connector provided by Apple Inc., a universal serial bus (e.g., USB), one or more conducted RF connectors, or other connectors and protocols.

The illustrated embodiments of the input structures 20, in combination with the display 18, may allow a user to control the handheld device 30B. For example, a first input structure 20 may activate or deactivate the handheld device 30B, one of the input structures 20 may navigate user interface to a home screen, a user-configurable application screen, and/or activate a voice-recognition feature of the handheld device 30B, while other of the input structures 20 may provide volume control, or may toggle between vibrate and ring modes. Additional input structures 20 may also include a microphone that may obtain a user's voice for various voice-related features, and a speaker to allow for audio playback and/or certain phone capabilities. The input structures 20 may also include a headphone input (not illustrated) to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 32 may be provided to protect and enclose internal components of the computer 30D such as the dual-layer display 18. In certain embodiments, a user of the computer 30D may interact with the computer 30D using various peripheral input devices, such as the keyboard 37 or mouse 38, which may connect to the computer 30D via an I/O interface 22.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, an organic light emitting diode display, an active-matrix organic light emitting diode (e.g., AMOLED) display, and so forth), which may allow users to interact with a user interface of the wearable electronic device 30E.

Figure 7:
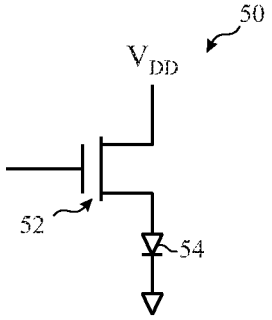
FIG. 7 is a schematic view of a unit pixel having a transistor and an illumination element, in accordance with an embodiment.

FIG. 7 illustrates a portion of unit pixel circuitry 50. The unit pixel circuitry 50 includes a control transistor 52 that controls emission levels of a light emitting diode (LED) 54. For example, the transistor 52 may include a thin film transistor (TFT). However, variations of parameters of operation of the transistor 52 may cause flicker or blur or other artifacts for the display 18. The operation parameters may include a gate-source voltage ($V_{GS}$) that is set according to a sampled threshold voltage ($V_{TH}$) of one or more transistors.

Figure 8:
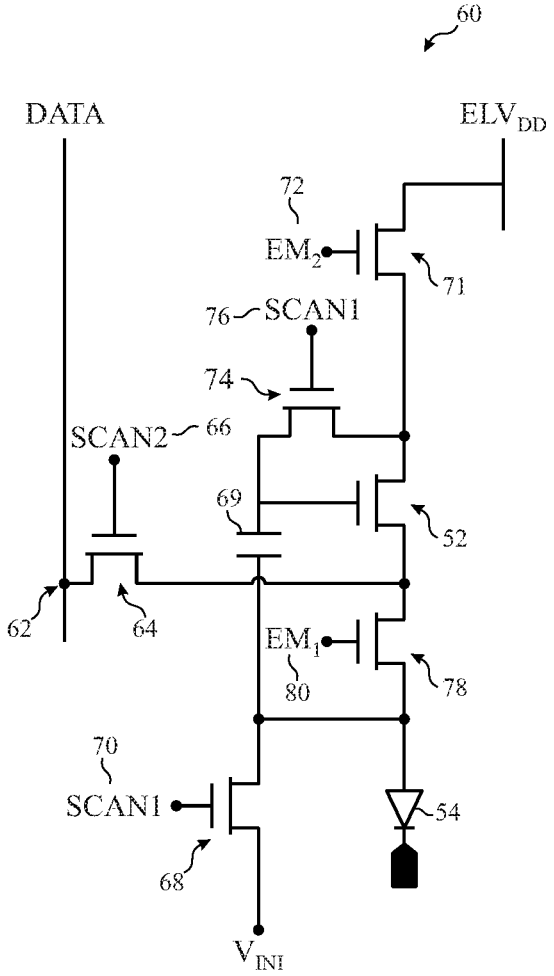
FIG. 8 is a more detailed schematic view of the unit pixel of FIG. 7, in accordance with an embodiment.

FIG. 8 illustrates a schematic of circuitry 60 for driving the LED 54 using the transistor 52. The circuitry 60 includes additional circuitry other than that illustrated in FIG. 7. Specifically, the circuitry 60 includes a data line 62 that passes grey level data to be displayed by the LED 54 and/or receives scan data from the circuitry 60 for sending back information to be used to compensate data (e.g., $V_{TH}$ compensation) using the processors 12. Connection of the data line 62 to other portions of the circuitry 60 is controlled by a scanning transistor 64 that receives a scan signal 66 to complete the connection during a data writing phase and/or scanning phase. The circuitry 60 also includes a charging transistor 68 that controls charging of a capacitor 69 that is used to apply a voltage to a gate of the transistor 52. The capacitor 69 enables application of the voltage to the transistor 52 without application of an active voltage supply. The connection of the capacitor to $V_{ini}$ is controlled using a scanning signal 70. The scanning signal 70 may be applied during a refresh period between emission periods when the capacitor 69 is charged, during a sampling and data programming phase, and/or when $V_{GS}$ stress is to be induced on the transistor 52. The circuitry 60 also includes a transistor 71 that toggles a connection to ELVDD based on an emission signal 72. When this emission signal 72 is active, ELVDD is coupled to a transistor 74. The transistor 74, when active, couples the capacitor 69 to ELVDD while the transistor 68 couples an opposite side of the capacitor 69 to $V_{ini}$. Thus, the capacitor 69 stores a voltage equal to ELVDD–$V_{ini}$. The circuitry 60 also includes an emission transistor 78 that causes the LED 54 to emit light based on the current through the transistor 52 and the assertion of an emission signal 80.

Figure 9:
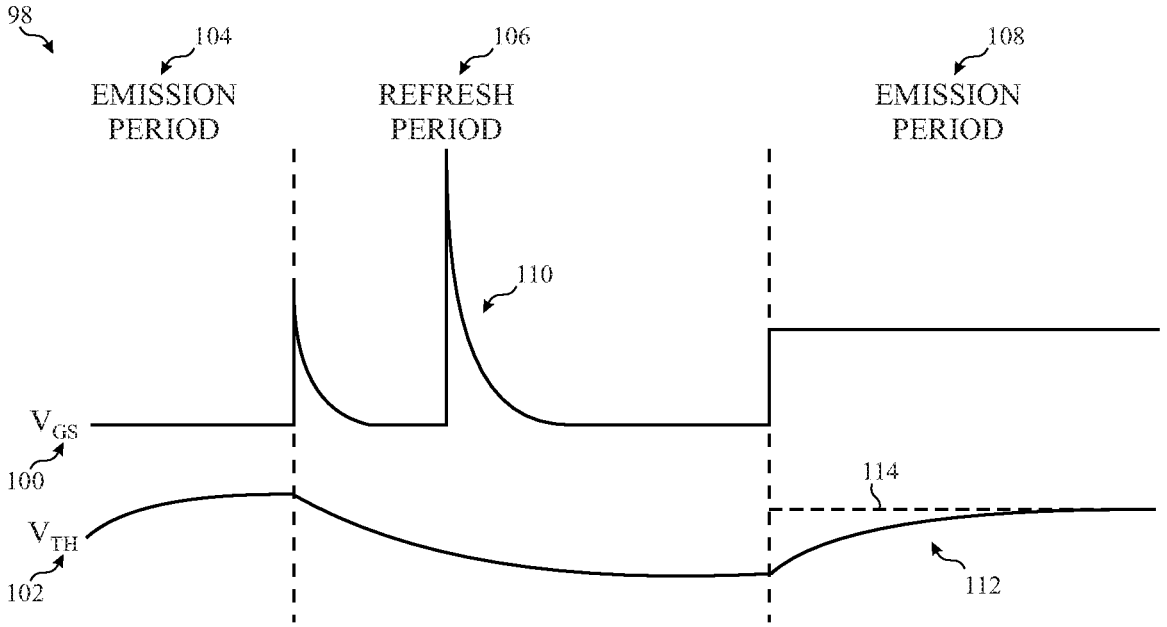
(Prior Art) FIG. 9
FIG. 9 is a graphical view of voltage levels in two consecutive emission periods with a refresh period therebetween, in accordance with an embodiment.

FIG. 9 illustrates a graph 98 illustrating a gate-source voltage ($V_{GS}$) 100 and resulting sampled threshold voltage ($V_{TH}$) 102. The graph 98 illustrates a first emission period 104 and a refresh period 106 and a later second emission period 108. As illustrated, during the refresh period 106 the $V_{GS}$ voltage undergoes fluctuations 110. That $V_{GS}$ voltage fluctuations 110 causes resulting fluctuations in the $V_{TH}$ that increases a settling time of the $V_{TH}$ possibly causing a $V_{TH}$ transient 112 that results in a transient-based flicker. As illustrated, the transient 112 occurs when the $V_{TH}$ 102 starts below a level 114 at the beginning of the emission period 108. As the $V_{TH}$ 102 settles to the level 114, the LED 54 may cause artifacts. These artifacts may include a flicker, a blur when scrolling, earlier frames displaying at a different level (e.g., dimmer or brighter) than later frames, and/or other artifacts.

Figure 10:
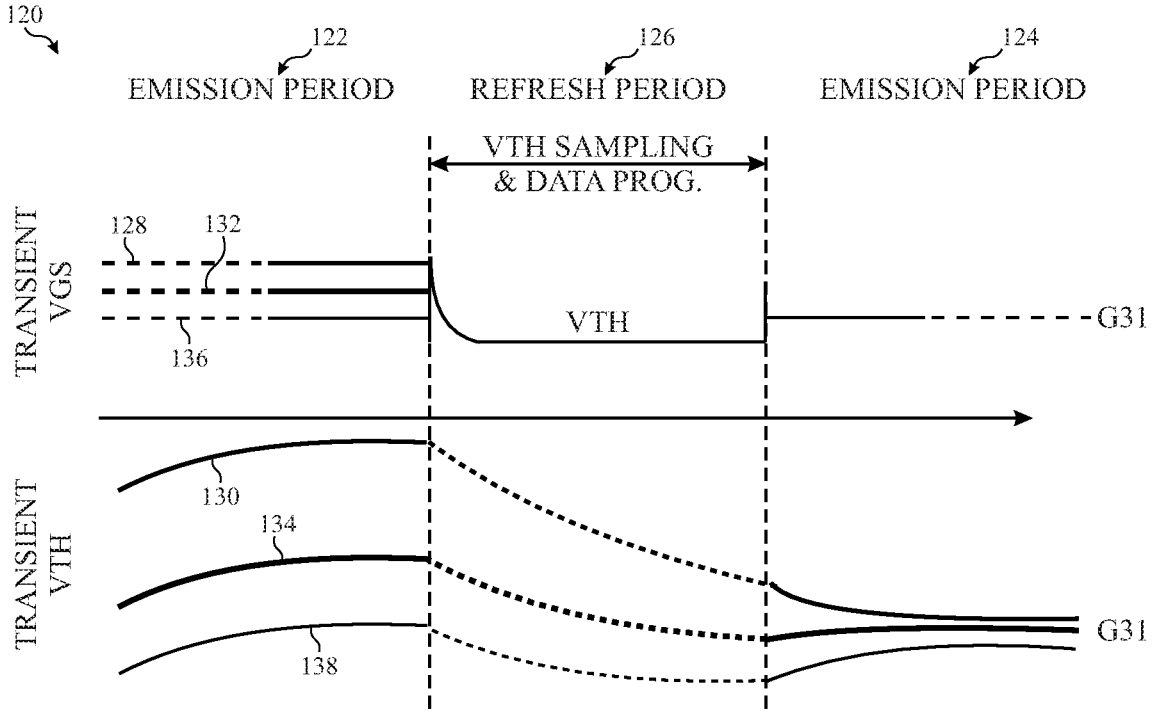
(Prior Art) FIG. 10
FIG. 10 is a graphical view of voltage levels in two consecutive emission periods with a refresh period therebetween illustrating different starting gray scale levels, in accordance with an embodiment.

The severity and/or type of these artifacts may differ depending on a previous gray scale level and a target gray scale level. FIG. 10 illustrates a graph 120 detailing different transitions from a first emission period 122 to a second emission period 124 through a refresh period 126. The graph 120 illustrates line 128 and 130 that respectively correspond to $V_{GS}$ levels and $V_{TH}$ levels during a transition from emitting a relatively high gray scale level (e.g., gray scale level 127 out of 256 gray scale levels) to emitting a relatively low gray scale level (e.g., gray scale level 31 out of 256 gray scale levels). The graph 120 also illustrates lines 132 and 134 that respectively correspond to $V_{GS}$ levels and $V_{TH}$ levels during a transition from emitting an intermediate gray scale level (e.g., gray scale level 63 out of 256 gray scale levels) to emitting the same relatively low gray scale level (e.g., gray scale level 31 out of 256 gray scale levels). The graph 120 further illustrates lines 136 and 138 that respectively correspond to $V_{GS}$ levels and $V_{TH}$ levels while maintaining emission at the relatively low gray scale level from the first emission period 122 to the second emission period 124. As illustrated, the $V_{GS}$ level of lines 128, 132, and 136 is gray scale level dependent. During the refresh period, $V_{TH}$ levels are sampled and stored into pixels while $V_{GS}$ is approximately equal to $V_{TH}$. However, if the $V_{TH}$ has not settled, the artifacts previously discussed may occur.

Figure 11:
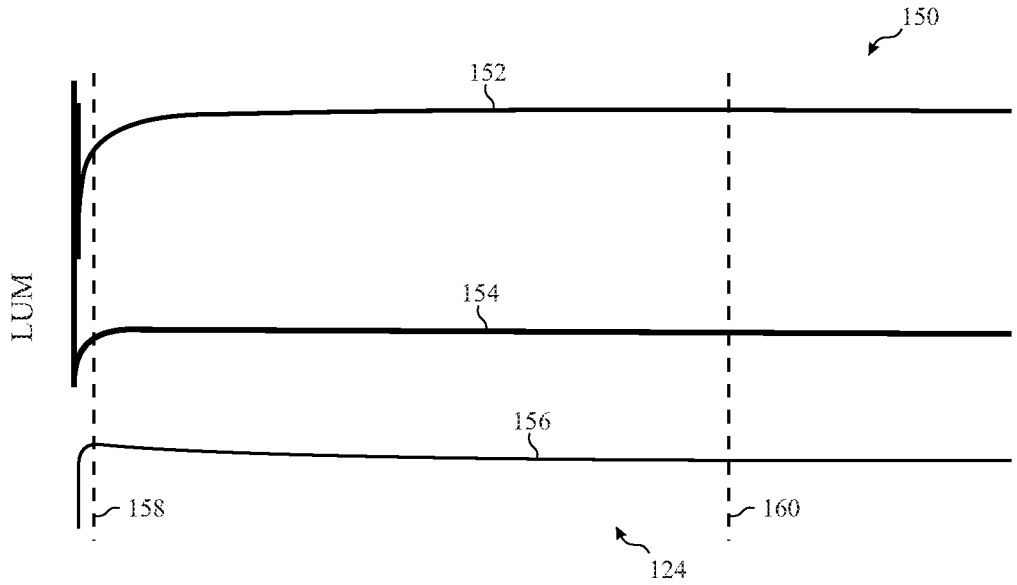
(Prior Art) FIG. 11
FIG. 11 is a graphical view of luminance in a subsequent emission period of the consecutive emission periods with hysteresis variation, in accordance with an embodiment.

As illustrated by the lines 130, 134, and 138, different previous gray scale levels may cause the $V_{TH}$ settle to different voltage levels thereby resulting in different luminance levels, as illustrated in FIG. 11. FIG. 11 illustrates a graph 150 of luminance levels of pixels over time during the second emission period 124 in relation to previous gray scale levels. The graph 150 includes lines 152, 154, and 156 that respectively correspond to a common gray scale level but with different previous gray scale levels. Line 152 corresponds to a previously high gray scale level; line 154 corresponds to a previously intermediate gray scale level; and line 156 corresponds to a low gray scale level that is maintained. As illustrated, during a first frame 158, luminance levels corresponding to each line differs from a luminance level at a later frame 160. Specifically, the first frame 158 for the lines 152 and 154 are dimmer than the later frame 160 while the first frame 158 for the line 156 is brighter than the later frame 160.

Figure 12:
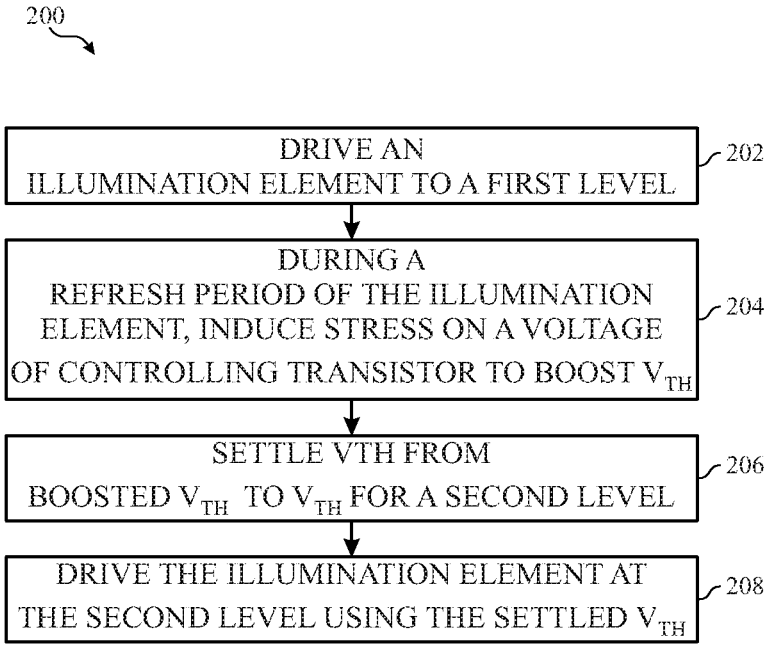
FIG. 12 is a flow diagram of a process for reducing likelihood of hysteresis-based artifacts, in accordance with an embodiment.

To reduce the likelihood of the blur, flicker, and first frame level issues, $V_{GS}$ may undergo stress during the refresh period 126 instead of being allowed to settle to $V_{TH}$. This increase in $V_{GS}$ in turn boosts $V_{TH}$ to a common level regardless of previous gray scale level. FIG. 12 illustrates a flow diagram of a process 200 for driving a pixel with reduced likelihood of artifacts due to hysteresis. The process 200 includes driving an illumination element to a first level during a first emission period (block 202). The illumination element may include any emissive element such as a light emitting diode (LED), organic light emitting diode (OLED), or other suitable emissive elements. The illumination element may be a self-emissive pixel (or sub-pixel) for a display. Additionally or alternatively, the illumination element may provide backlighting for the display (e.g., liquid crystal display).

During a refresh period for the illumination element, the processors 12 induce stress on a voltage of a controlling transistor to boost $V_{TH}$ before settling (block 204). The voltage may include the $V_{GS}$ of the transistor 52. The voltage boosts the $V_{TH}$ during an initialization portion during the refresh period before allowing the $V_{TH}$ to settle during a sampling and data programming portion of the refresh period. The $V_{TH}$ of the controlling transistor for the illumination element is boosted to a single level regardless of previous gray scale level and target gray scale level. This boosted $V_{TH}$ level may be set based on a target gray scale level. Additionally or alternatively, the $V_{TH}$ level may be static for any target gray scale level. In some embodiments, a duration of boosting of the $V_{TH}$ for the controlling transistor according to the level of the boosted $V_{TH}$. In some embodiments, this duration may be determined dynamically along with the boosted level for the $V_{TH}$ that is static or based on the target gray scale level. Additionally or alternatively, the duration may be set to a period that is long enough to accommodate any boosted $V_{TH}$ level that may be used based on target gray scale levels.

Figure 13:
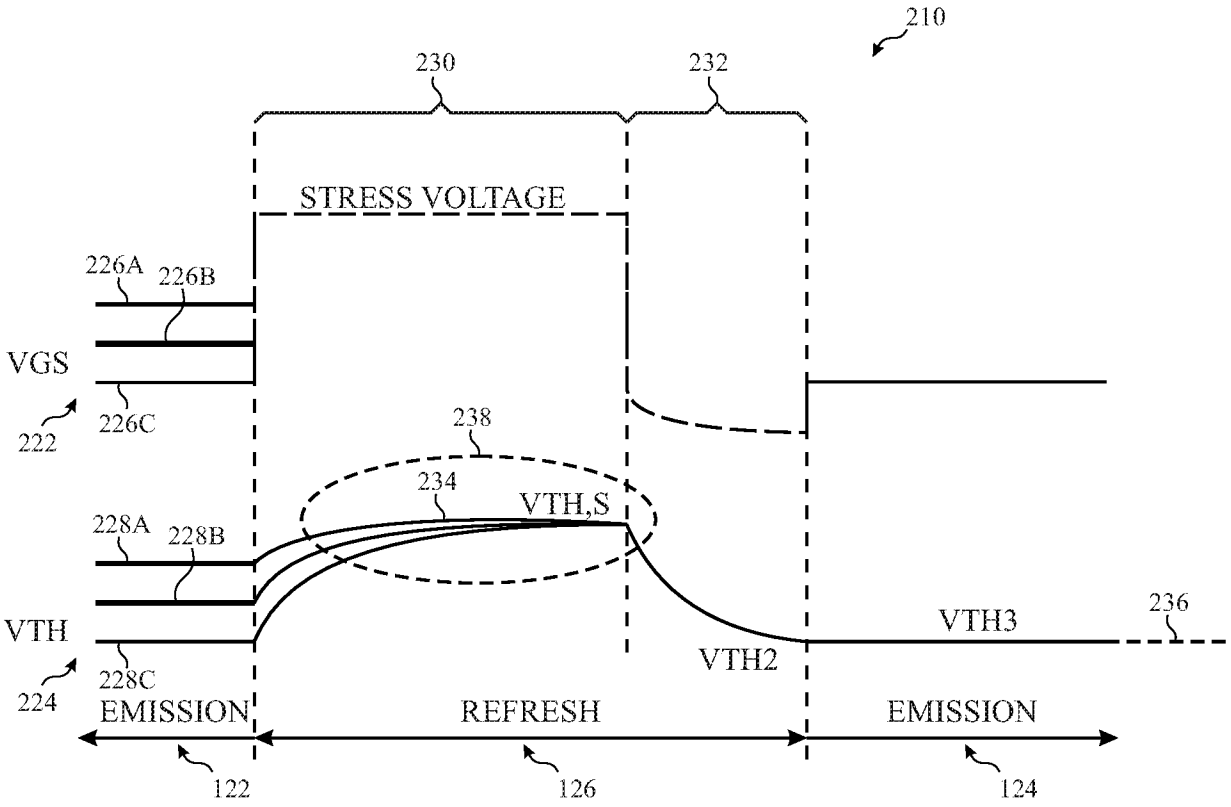
FIG. 13 is a graphical view of voltage levels in two consecutive emission periods with a refresh period therebetween illustrating different starting gray scale levels, in accordance with an embodiment.

FIG. 13 is a graph 220 illustrating a boosted $V_{TH}$ using $V_{GS}$ stress to induce the boost. The graph 220 includes $V_{GS}$ levels 222 with different previous gray scale levels and $V_{TH}$ levels 224 with the same respective previous gray scale levels. For instance, the $V_{GS}$ levels include lines 226A, 226B, and 226C that each correspond to $V_{GS}$ levels corresponding to high (e.g., gray scale level 127), medium (e.g., gray scale level 63), and low (e.g., gray scale level 31) gray scale levels, respectively. Similarly, the $V_{GS}$ levels include lines 228A, 228B, and 228C that each correspond to $V_{TH}$ levels corresponding to the same high (e.g., gray scale level 127), the same medium (e.g., gray scale level 63), and the same low (e.g., gray scale level 31) gray scale levels, respectively.

As illustrated, the refresh period 126 is divided into an initialization portion 230 and a sampling and data programming portion 232. During the initialization portion 230, $V_{GS}$ is increased as $V_{GS}$ stress by connecting the gate of the controlling transistor 52 to a first voltage (e.g., ELVDD) while connecting the source of the controlling transistor 52 to a second voltage (e.g., $V_{ini}$). The connection of the source of the transistor 52 may be completed in the circuitry 60 by asserting the scanning signal 70 and the emission signal 80 to couple the source of the transistor 52 to $V_{ini}$ via the transistor 68 and the transistor 78. Asserting the scanning signal 70 and the emission signal 72 via the transistors 71 and 74 may make the connection of the gate of the transistor 52 to ELVDD. In other words, the processors 12 may invoke the initialization portion 230 to assert the stress voltage as $V_{GS}$ on the transistor 52 by asserting the scanning signal 70, the emission signal 72, and the emission signal 80. The amplitude of the stress voltage may be determined based on a target gray scale level. Since the length of the sampling and data programming portion 232 is established, an amount of time for which settling occurs from the boosted $V_{TH}$ to the target $V_{TH}$ is known. The target boosted $V_{TH}$ level 234 may be ascertained (e.g., using a look up for empirical data) using the length of the sampling and data programming portion 232 and a target emission $V_{TH}$ level 236 that is based on a gray scale level to be used during emission. Since the target boosted $V_{TH}$ level 234 is independent of previous gray scale levels, the target emission $V_{TH}$ level is known, and the length of the sampling and data programming portion 232 is predetermined; each target emission $V_{TH}$ level may have a single corresponding target boosted $V_{TH}$ level 234 to result in the target emission $V_{TH}$ level 236 after settling the duration of the sampling and data programming portion 232.

Since the target boosted $V_{TH}$ level 234 may be dynamically determined and previous gray scale levels may also be dynamic, some $V_{TH}$ values may take longer than others to settle to the target boosted $V_{TH}$ level 234. Thus, the duration for the initialization portion 230 may be set to a length that will accommodate a longest possible duration of settling from any possible gray scale level to any possible target boosted $V_{TH}$ level 234. Additionally or alternatively, the length of the initialization portion 230 may be dynamically determined based at least in part on the target boosted $V_{TH}$ level 234 and/or a previous gray scale level to ensure that $V_{TH}$ can settle at the target boosted $V_{TH}$ level 234 prior to the sampling and data programming portion 232. Once the target boosted $V_{TH}$ level 234 is reached, $V_{TH}$ settles to the target emission $V_{TH}$ level 236 during the sampling and data programming portion 232.

Figure 14:
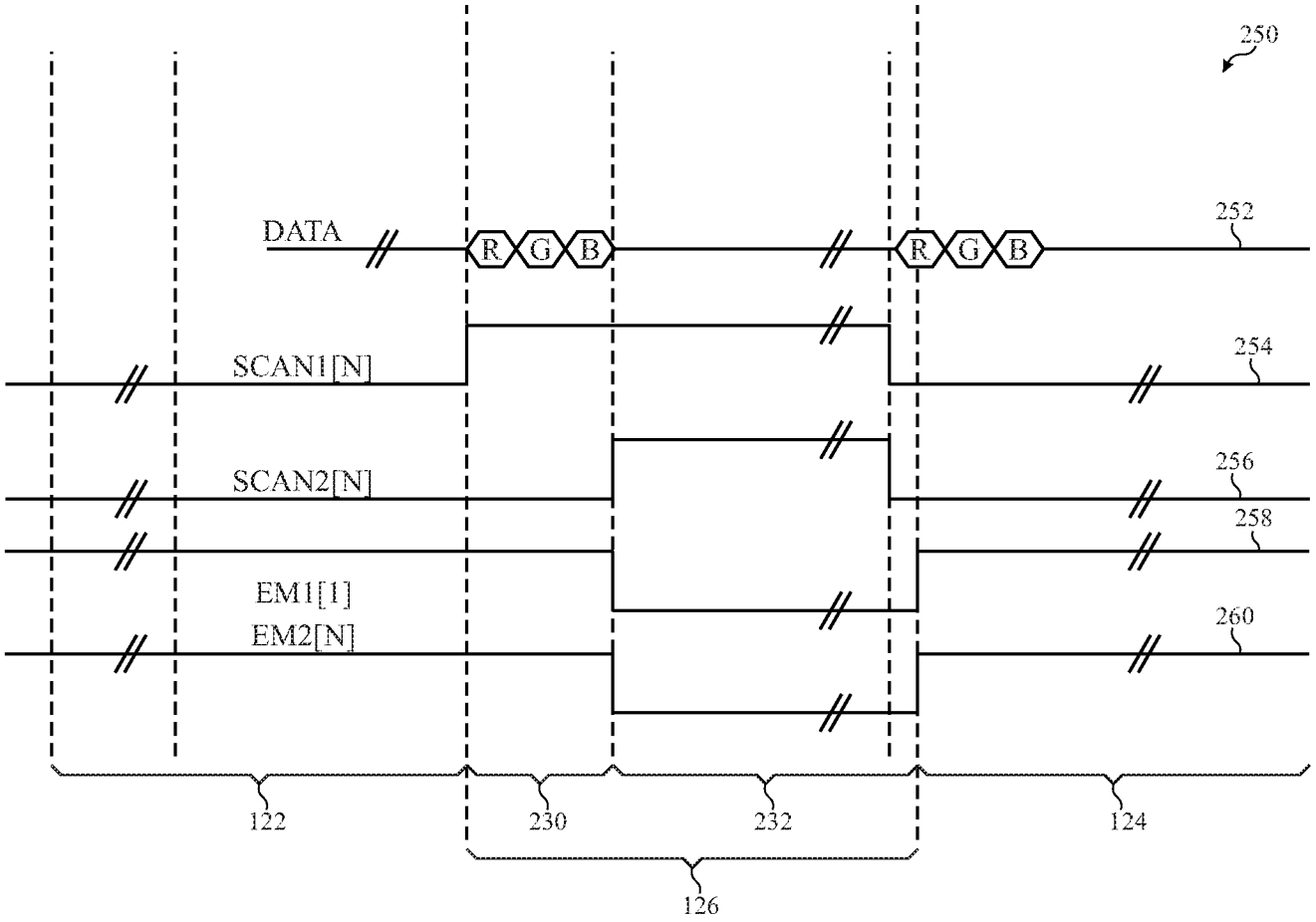
FIG. 14 is a timing diagram for implementing the voltage levels of FIG. 13, in accordance with an embodiment.

FIG. 14 illustrates a timing diagram 250 for driving the circuitry 60 to reduce likelihood of display artifacts due to $V_{TH}$ incomplete settling. As illustrated, the timing diagram shows that data 252 is transmitted over the data line 62 during the sampling and data programming portion 232. A scanning signal 254 that, when logic high, corresponds to a signal indicating that the pixel(s) are in the refresh period 126 causing the transistors 68 and 74 to be in a conductive state. The scanning signal 254 corresponds to the scanning signal 70 of FIG. 8. An additional scanning signal 256 corresponds to an indication that the sampling and data programming portion 232 has initiated. The additional scanning signal 256 corresponds to the scanning signal 66 of FIG. 8 that causes the transistor 64 to couple the data line 62 to the source of the transistor 52. The timing diagram 250 further includes one or more emission signals 258 and 260. In some embodiments, a single signal is used for the emission signals. The emission signal(s) 258 and 260 indicate that the pixel is in the emission period 122, emission period 124, or the initialization portion 230. The emission signal 258 enables current to be passed to the LED 54 to emit light. The emission signal 260 (along with the scanning signal 254) couples ELVDD to the gate of the transistor 52. Since the initialization portion 230 corresponds to a logic high of the scanning signal 254, the emission signal 258, and the emission signal 260, source of the transistor 52 is coupled to $V_{ini}$. Thus, during the initialization portion 230, the transistor 52 undergoes $V_{GS}$ stress equal to ELVDD−$V_{ini}$ thereby boosting $V_{TH}$. As previously discussed, the level of the boosted $V_{TH}$ may be dynamically set by tuning ELVDD or $V_{ini}$ to achieve the boosted $V_{TH}$ level.

Figure 15:
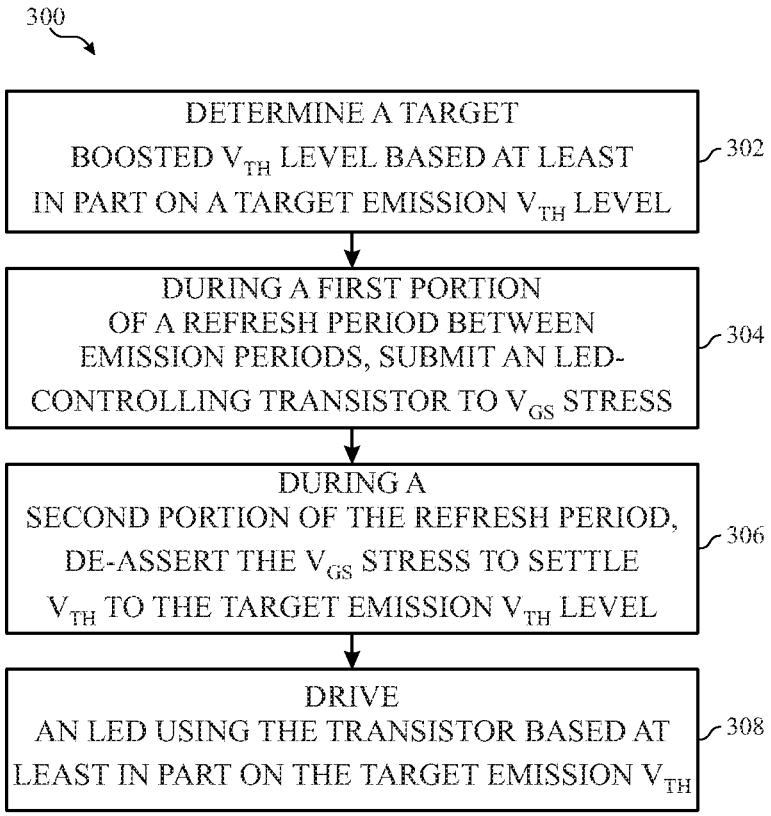
FIG. 15 is a flow diagram of a process for reducing likelihood of hysteresis-based artifacts by submitting a transistor to voltage stress during a refresh period, in accordance with an embodiment.

FIG. 15 is a flow diagram of a process 300 for reducing a likelihood of visual artifacts due to $V_{TH}$ settling issues. As previously discussed, the artifacts may include flicker, blur, and/or luminance fluctuations between frames. The process 300 includes the processors 12 determining a target boosted $V_{TH}$ level that is based at least in part on a target emission $V_{TH}$ level (block 302). The target emission $V_{TH}$ level is dependent on a target gray scale level for a subsequent emission period, and the target boosted $V_{TH}$ level is based at least in part on the target emission $V_{TH}$ level. Specifically, the target boosted $V_{TH}$ level may be a level from which the $V_{TH}$ will settle to the target emission $V_{TH}$ during a sampling and data programming period before an emission period.

During a first portion of a refresh period between two emission periods, the processors 12 cause a controlling transistor for a light emitting diode (LED) to undergo $V_{GS}$ stress (block 304). The processors 12 cause the transistor to be submitted to $V_{GS}$ stress by sending signals to transistors to couple the gate and the source of the transistor to different voltages. In some embodiments, one or more of these voltages are tunable to produce the target boosted $V_{TH}$ level by adjusting the amount of voltage stress under which the transistor is submitted during the first portion of the refresh period. During a second portion of the refresh period, the processors 12 de-assert the $V_{GS}$ stress to settle $V_{TH}$ to the target emission $V_{TH}$ level (block 306). Once the $V_{TH}$ has settled, the processors 12 drive the LED 54 using the transistor 52 based at least in part on the target emission $V_{TH}$ (block 308).

Figure 16:
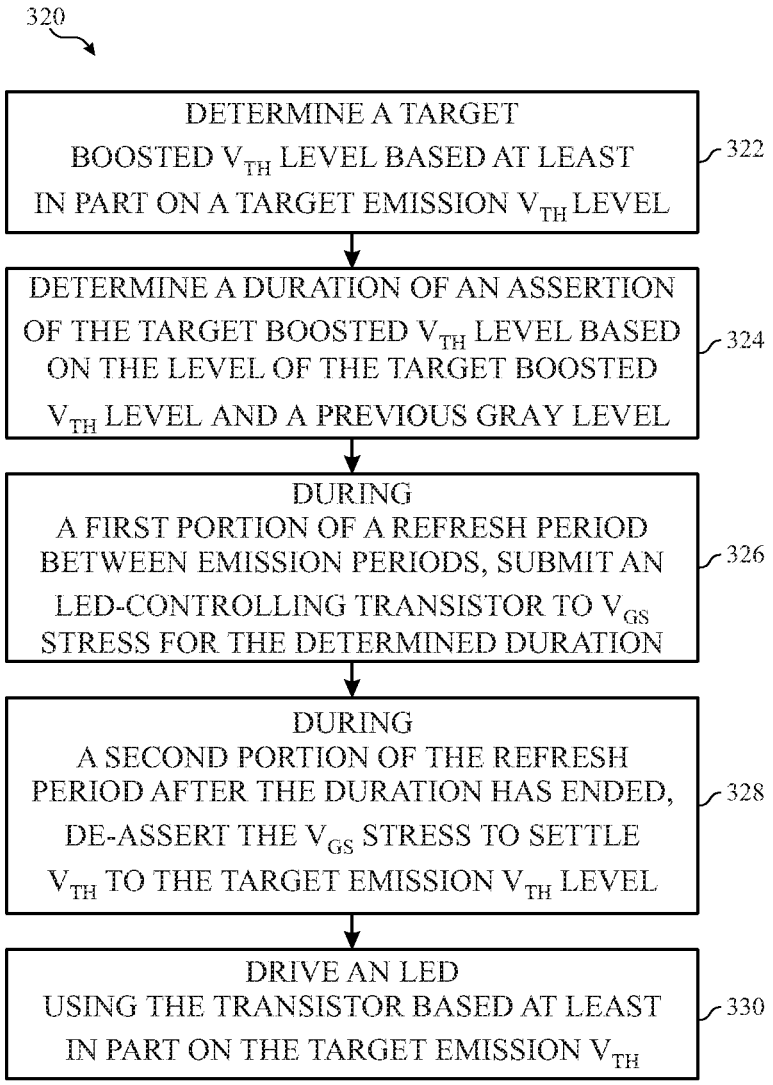
FIG. 16 is a flow diagram of a process for reducing likelihood of hysteresis-based artifacts by submitting a transistor to voltage stress for a variable duration during a refresh period, in accordance with an embodiment.

FIG. 16 is a flow diagram of a process 320 for reducing a likelihood of visual artifacts due to $V_{TH}$ settling issues using a variable-duration period of $V_{GS}$ stress. The process 320 includes the processors 12 determining a target boosted $V_{TH}$ level that is based at least in part on a target emission $V_{TH}$ level (block 322). As previously discussed, the target emission $V_{TH}$ level is dependent on a target gray scale level for a subsequent emission period, and the target boosted $V_{TH}$ level is based at least in part on the target emission $V_{TH}$ level. Specifically, the target boosted $V_{TH}$ level may be a level in which the $V_{TH}$ settles to the target emission $V_{TH}$ during a sampling and data programming period before an emission period.

The processors 12 also determine a duration of an assertion of the target boosted $V_{TH}$ level and a previous gray scale level (block 324). The duration may be a length that is suitable to ensure that the $V_{TH}$ can settle to the target boosted $V_{TH}$ level from the $V_{TH}$ level associated with the previous gray scale level.

During a first portion of a refresh period between two emission periods, the processors 12 cause a controlling transistor for a light emitting diode (LED) to undergo $V_{GS}$ stress for the determined duration (block 326). The processors 12 cause the transistor 52 to be submitted to $V_{GS}$ stress by sending signals to transistors to couple the gate and the source of the transistor 52 to different voltages. For example, the processors 12 may cause scanning signal 70 and emission signals 72 and 80 to cause transistors 71 and 74 to couple ELVDD to a gate of the transistor 52 and to cause transistor 68 and transistor 78 to couple $V_{ini}$ to a source of the transistor 52. In some embodiments, one or more of these voltages are tunable to produce the target boosted $V_{TH}$ level by adjusting the amount of voltage stress under which the transistor is submitted during the first portion of the refresh period. During a second portion of the refresh period after the duration has ended, the processors 12 de-assert the $V_{GS}$ stress to settle $V_{TH}$ to the target emission $V_{TH}$ level (block 328). Once the $V_{TH}$ has settled, the processors 12 drive the LED 54 using the transistor 52 based at least in part on the target emission $V_{TH}$ (block 330).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display including one or more pixels, wherein each pixel of the one or more pixels comprises:

an illumination element; and at least one transistor controlling emission of the illumination element; and one or more processors configured to:

during a non-emission period of the illumination element of a pixel of the one or more pixels, cause a transistor of the respective at least one transistor of the respective pixel to undergo voltage stress to increase a threshold voltage of the transistor of the respective at least one transistor of the respective pixel to a first threshold voltage level;

during the non-emission period after causing the transistor of the respective at least one transistor of the respective pixel to undergo voltage stress, de-assert the voltage stress to settle the threshold voltage of the transistor of the respective at least one transistor of the respective pixel to a second threshold voltage level less than the first threshold voltage level; and during an emission period, drive the illumination element based at least in part on the second threshold voltage level.

2. The electronic device of claim 1, wherein the illumination element comprises a light emitting diode or an organic light emitting diode.

3. The electronic device of claim 1, wherein the non-emission period of the illumination element comprises a refresh period for the illumination element between the emission period and a previous emission period.

4. The electronic device of claim 1, wherein the one or more processors are configured to determine an amplitude of the voltage stress that will result in the second threshold voltage level to be equal to a target emission threshold voltage for the emission period.

5. The electronic device of claim 4, wherein the target emission threshold voltage is based at least in part on a gray scale level to be displayed during the emission period.

6. The electronic device of claim 5, wherein determining the amplitude of the voltage stress comprises accessing a look up table.

7. The electronic device of claim 6, wherein the look up table is indexed by gray scale level to be emitted in the emission period.

8. The electronic device of claim 1, wherein the non-emission period comprises a refresh period that includes:

an initialization portion in which the transistor of the respective at least one transistor of the respective pixel undergoes voltage stress; and a sampling and data programming portion after the initialization portion in which data is programmed to a capacitor configured to drive the illumination element and the first threshold voltage level of the transistor of the respective at least one transistor of the respective pixel settles.

9. The electronic device of claim 1, comprising:

a first stress transistor that is configured to receive a first emission signal; and a second stress transistor that is configured to receive a scanning signal, wherein the first stress transistor and the second stress transistor couple a source of the transistor of the respective at least one transistor of the respective pixel to a first voltage upon assertion of logic high for the first emission signal and the scanning signal.

10. The electronic device of claim 9, comprising:

a third stress transistor that is configured to receive a second emission signal; and a fourth stress transistor that is configured to receive the scanning signal, wherein the third stress transistor and the fourth stress transistor couple a gate of the transistor of the respective at least one transistor of the respective pixel to a second voltage upon assertion of logic high for the second emission signal and the scanning signal.

11. The electronic device of claim 10, wherein the second voltage is greater than the first voltage.

12. The electronic device of claim 10, wherein the one or more processors are configured to adjust an amplitude of the voltage stress by adjusting the first or second voltage, and the voltage stress equals the second voltage minus the first voltage.

13. A tangible, non-transitory, machine-readable storage medium storing one or more programs that are executable by one or more processors of an electronic device with a display, the one or more programs including instructions to:

determine a target increased threshold voltage level for a light emitting diode (LED)-controlling transistor based at least in part on a target emission threshold voltage level;

during a first portion of a refresh period between a first emission period and a second emission period, submit the LED-controlling transistor to gate-to-source voltage stress to increase a threshold voltage of the LED-controlling transistor to the target increased threshold voltage;

during a second portion of the refresh period, de-assert the gate-to-source voltage stress to settle the threshold voltage from the target increased threshold voltage level to the target emission threshold voltage level prior to the second emission period, wherein the target emission threshold voltage level is less than the target increased threshold voltage level; and drive the LED-controlling transistor during the second emission period based at least in part on the target emission threshold voltage level.

14. The tangible, non-transitory, machine-readable storage medium of claim 13, wherein target emission threshold voltage corresponds to a gray scale level to be displayed during the second emission period.

15. The tangible, non-transitory, machine-readable storage medium of claim 13, wherein an amount of gate-to-source voltage stress is configured to increase the threshold voltage to the target increased threshold voltage level that is at least partially based on the target emission threshold voltage level.

16. The tangible, non-transitory, machine-readable storage medium of claim 15, wherein the first portion comprises an initialization portion that has a duration for the initialization portion sufficient to settle the threshold voltage from the target increased threshold voltage level within the second portion.

17. The tangible, non-transitory, machine-readable storage medium of claim 16, wherein the duration is based at least in part on a gray scale level to be displayed during the first emission period and the target increased threshold voltage level.

18. The tangible, non-transitory, machine-readable storage medium of claim 16, wherein the duration is determined before application of the gate-to-source voltage stress and is determined to be long enough to settle any threshold voltage level corresponding to any possible gray scale level for the first emission period to any target increased threshold voltage level.

19. The tangible, non-transitory, machine-readable storage medium of claim 13, wherein the second portion includes a sampling and data programming portion of the refresh period in which image data is transmitted via a data line.

20. A method comprising:

determining a target increased threshold voltage level for a transistor of a unit pixel of a plurality of unit pixels in a display, wherein the target increased threshold voltage level enables settling of a threshold voltage of the transistor to settle to a target emission threshold voltage level during a refresh period, wherein the target emission threshold voltage level is less than the target increased threshold voltage level;

increasing the threshold voltage to the target increased threshold voltage level by submitting the transistor to voltage stress during the refresh period after a first emission period and before a second emission period for the unit pixel;

settling the threshold voltage to the target emission threshold voltage level from the target increased threshold voltage level during the refresh period by de-asserting the voltage stress; and driving the unit pixel based at least in part on the target emission threshold voltage level during the second emission period.

* * * * *